United States Patent [19]

Nadaskay

[11] Patent Number: 4,577,761

[45] Date of Patent: Mar. 25, 1986

[54] EASY-OPEN PINCH CLOSURE BAG

[75] Inventor: Richard J. Nadaskay, Camden, Ark.

[73] Assignee: International Paper Company, New York, N.Y.

[21] Appl. No.: 716,046

[22] Filed: Mar. 26, 1985

[51] Int. Cl.[4] ..... B65D 33/00

[52] U.S. Cl. ..... 206/604; 206/610

[58] Field of Search ..... 206/610, 628, 613, 629, 206/604; 383/85, 114

[56] References Cited

U.S. PATENT DOCUMENTS

| | | | |
|---|---|---|---|
| 2,306,335 | 12/1942 | Feigenbutz | 206/610 |
| 2,867,372 | 1/1959 | Fox | 206/610 |
| 4,008,850 | 2/1977 | Goodrich | 383/85 |
| 4,441,613 | 4/1984 | Hain et al. | 206/628 |

*Primary Examiner*—Stephen P. Garbe

*Attorney, Agent, or Firm*—Thomas J. Vetter

[57] ABSTRACT

A multi-ply pinch closure bag having an easy-open feature. The bag comprises a multi-ply bag having a front wall, a back wall and a pinch closure at one end, the pinch closure being formed by folding an extension of at least one of the plies of the back wall over the outside of the outermost ply of the front wall and adhesively securing the extension to the outermost ply of the front wall. The outermost ply of the front wall has a longitudinal seam formed by overlapped longitudinal edges of the outermost ply and means for breaking the outermost ply across the longitudinal seam. In a preferred embodiment, the means for breaking the outermost ply across the longitudinal seam comprises two slits, one being adjacent to each edge of the longitudinal seam.

8 Claims, 8 Drawing Figures

EASY-OPEN PINCH CLOSURE BAG

FIIELD OF THE INVENTION

This invention relates to multi-ply pinch closure bags. More particularly, the invention relates to multi-ply pinch closure bags having an easy-open feature.

BACKGROUND OF THE INVENTION

Pinch closure bags, which may be used conveniently to store and transport such materials as grain, animal feed, fertilizer and other materials in powdered, granular or pellet form are typically made with multi-ply walls, the pinch closure being formed at one or both ends by folding an extension flap of one wall of the bag over the open end and adhesivey securing the flap to the outside ply of the other wall. For an example of a pinch closure bag, see Becker U.S. Pat. No. 3,203,620. Pinch closure bags are typically made so as to be resistant to tearing and breakage. Consequently, such bags may be difficult to open when, for example, a user wishes to remove the bag's contents.

Efforts have been made to provide convenient means for opening multi-ply pinch closure bags. For example, it has been proposed to incorporate extraneous components such as string and/or paper tabs as devices to assist in opening pinch closure bags. According to one such proposal, a paper tab would be inserted in the pinch closure between the adhesively secured extension flap and the outside wall of the bag. The tab would be arranged so that by pulling the tab, the portion of the flap overlying the tab would pull away from the remainder of the flap to form an opening for pouring. Such proposals, however, present a problem in that they require that a separate device be applied to the bag. Also, in the case of applying a tab to the pinch closure, there is the added disadvantage that the tab must be adhesively secured to the wall of the bag underlying the flap in order to provide a tight pinch closure. This may interfere with the pulling of the tab. If a weak adhesive were used for this purpose, it might unduly weaken the pinch closure.

Multi-ply pinch closure bags purportedly having an easy-open feature without the use of extraneous devices have also been proposed. U.S. Pat. No. 3,565,328 refers to the provision of a "tear tab" formed by a portion of the outer ply of the bag, as distinguished from a separate device. The patent also refers to a "tear strip" which is a separate paper strip adhesively secured under the closure flap to assist in opening the bag. This proposal, however, does not disclose or suggest an easy-open feature which takes full advantage of the strengths and weaknesses present in a pinch closure bag.

SUMMARY OF THE INVENTION

The present invention is directed to a multi-ply pinch closure bag having a novel easy-open feature which takes full advantage of the strengths and weakneses of a pinch closure bag to effect opening of the bag and which does not require the addition of any extraneous device to obtain, or render operative, the easy-open feature.

More particularly, the instant invention provides an easy-open pinch closure bag comprising a multi-ply bag having a front wall, a back wall and a pinch closure at one end, the pinch closure being formed by folding an extension of at least one of the plies of the back wall over the outside of the outermost ply of the front wall and adhesively securing the extension to the outermost ply of the front wall, the outermost ply of the front wal having a longitudinal seam formed by overlapped longitudinal edges of the outermost ply and means for breaking the outermost ply across the longitudinal seam.

In a preferred embodiment of the invention, the means for breaking the outermost ply comprises two slits, one slit being adjacent to each edge of the longitudinal seam of the outermost ply, the slits being of sufficient length to permit the insertion of a finger under the longitudinal seam of the outermost ply.

With respect to the present invention, longitudinal refers to the direction running from one end of a bag tube to the other end and will typically correspond to the machine direction of the bag tube during manufacture.

DETAILED DESCRIPTION OF THE INVENTION

Figures 1, 2, 3, 4:
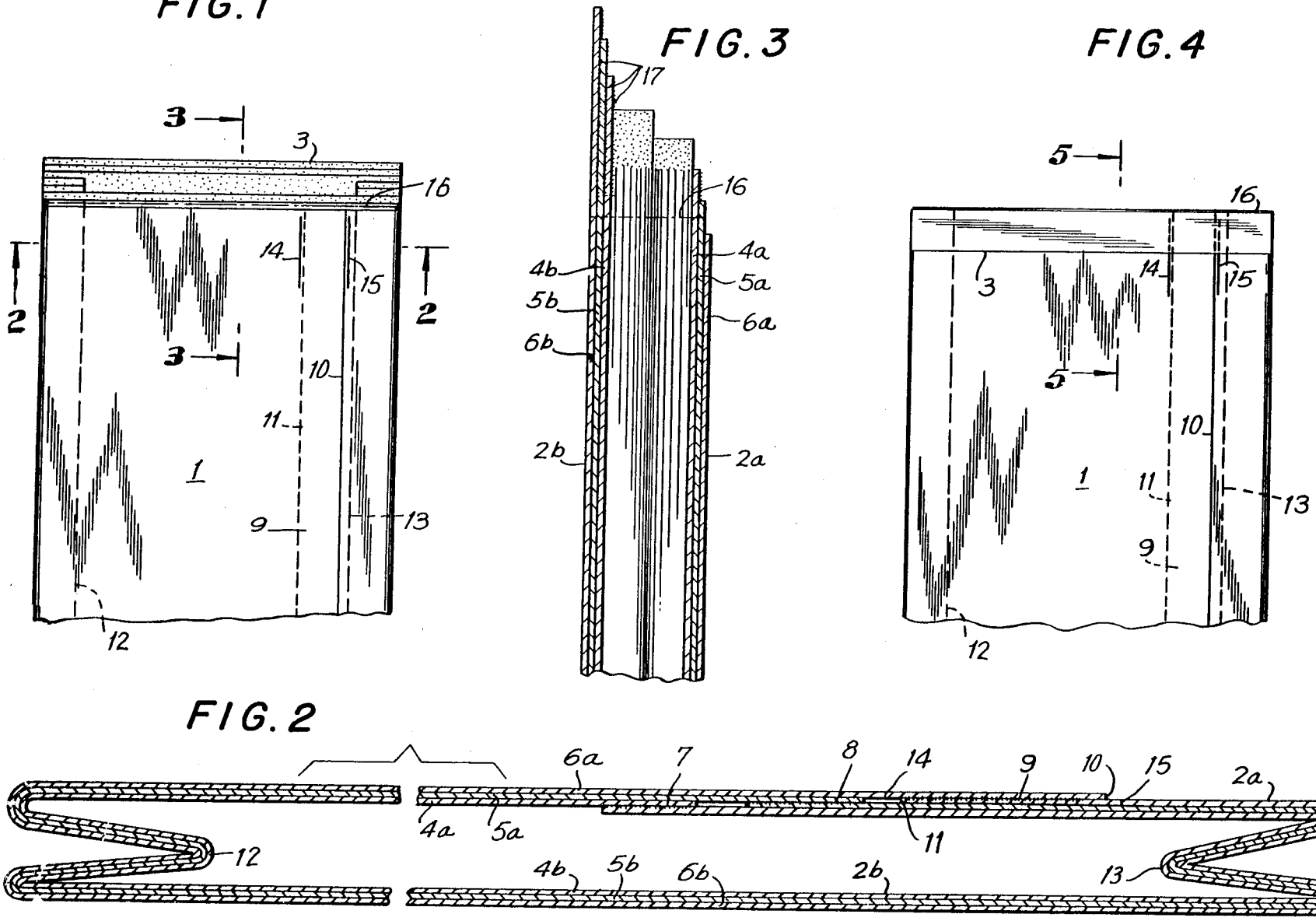
FIG. 1 is a front elevation of a multi-ply bag tube to be formed into a multi-ply pinch closure bag according to this invention.
FIG. 2 is a cross-section on line 2—2 of FIG. 1 with the tube spread slightly open and with ply thicknesses exaggerated.
FIG. 3 is a longitudinal section on line 3—3 of FIG. 1 with the tube spread slightly open and with ply thicknesses exaggerated.
FIG. 4 is a front elevation of the FIG. 1 bag tube with a pinch closure extension flap folded over and sealed.

Referring to FIGS. 1, 2 and 3, there is illustrated a multi-ply bag tube 1 having a front wall 2*a*, a back wall 2*b* and an extension flap 3 at one end adapted to form a pinch closure at that end. The bag tube illustrated is a 3-ply tube including an innermost ply 4, an intermediate ply 5 and an outermost ply 6. For clarity, the plies of the front wall 2*a* have been designated 4*a*, 5*a* and 6*a*, respectively, whereas the plies of the back wall 2*b* have been designated 4*b*, 5*b* and 6*b*, respectively.

The multi-ply bag tube 1 is formed in known manner such as, for example, by combining three webs or plies of paper, forming the combined plies into tubing and segmenting the tubing into tubes. See, e.g., U.S. Pat. No. 3,203,620. In forming the bag tubing by such a method, one longitudinal edge of each ply is overlapped by, and adhesively secured to, the other longitudinal edge of the same ply forming a longitudinal seam in the bag tube. Such longitudinal seams formed by the overlap of the respective longitudinal ply edges are illustrated in FIG. 2 as 7, 8 and 9 for plies 4, 5 and 6, respectively. The location of longitudinal seam 9 is also shown in FIG. 1 and is defined by longitudinal edges 10 and 11 of ply 6. As illustrated in FIGS. 1 and 2, ply edge 10 overlaps ply edge 11 so that ply edge 10 is visible from the outside of the bag tube. Aso, as shown in FIG. 2, longitudinal seams 7, 8 and 9 may be offset transversly so as not to be one above the other.

The bag illustrated is of the gusseted type having gussets 12 and 13. For specific examples of gusseted-type pinch closure bags, see U.S. Pat. Nos. Re. 28,317 and 28,318. The instant invention, however, is applicable to multi-ply pinch closure bags of both gusseted and non-gusseted designs. Also, as illustrated in the figures, extension flap 3 is an extension of plies 4*b*, 5*b*, and 6*b* of back wall 2*b*. Extension flaps adapted to form a pinch closure according to the instant invention, however, may be formed from an extension of any number of the plies of the wall. As illustrated in the figures, the plies of extension flap 3, and the plies forming the gussets, may be stepped in known manner to obtain a better seal of the pinch closure. The instant invention may be applied equally to these various pinch closure constructions.

Also shown in the figures are two longitudinal slits 14 and 15 in outermost ply 6*a* located adjacent to the edges of longitudinal seam 9. Slit 14 is located adjacent to ply edge 11, and slit 15 is located adjacent to ply edge 10. It is preferred, but not essential, that the slits be located so that the ply edges 10 and 11 lie between the slits.

Although only one end of bag tube 1 has been illustrated, it should be understood that a pinch closure may likewise be formed at the other end of the bag tube in known manner. As should be apparent, however, a pinch closure formed at the other end using an extension flap formed from front wall 2*a* would not overlap a longitudinal seam. Accordingly, the slits 14 and 15 used in conjunction with the longitudinal seam 9 in accordance with the instant invention would find no application to a pinch closure thus formed at the other end.

Figure 5:
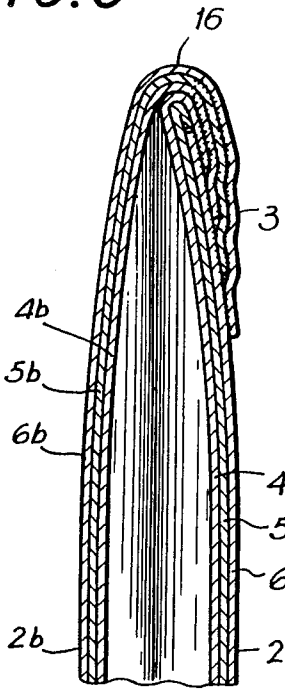
FIG. 5 is a longitudinal section on line 5—5 of FIG. 4 with the tube spread slightly open and with ply thicknesses exaggerated.

As shown in FIGS. 4 and 5, extension flap 3 is folded along fold line 16 in known manner to form a pinch closure at the end of bag tube 1. Adhesive 17 applied between the plies of the extension flap and between the outside of ply 6*a* and the inside of extension flap 3 serves to adhesively secure the extension flap to the outside of ply 6*a* and to secure the pinch closure. Although it is preferred to use a hot melt adhesive in securing the pinch closure, any of the various other types of adhesive conventionally employed may be used.

Figure 8:
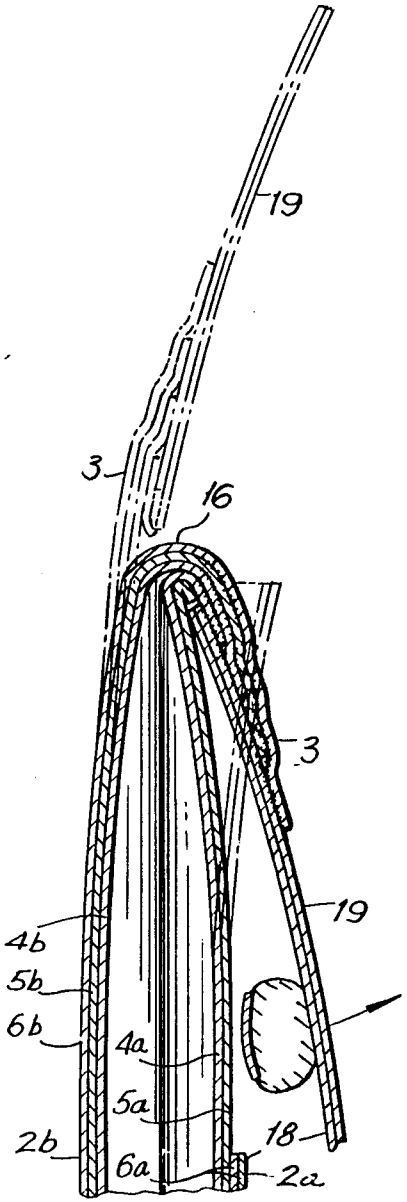
FIG. 8 is a longitudinal section along line 8—8 of FIG. 6 showing use of the easy open feature of the invention.
Figure 6:
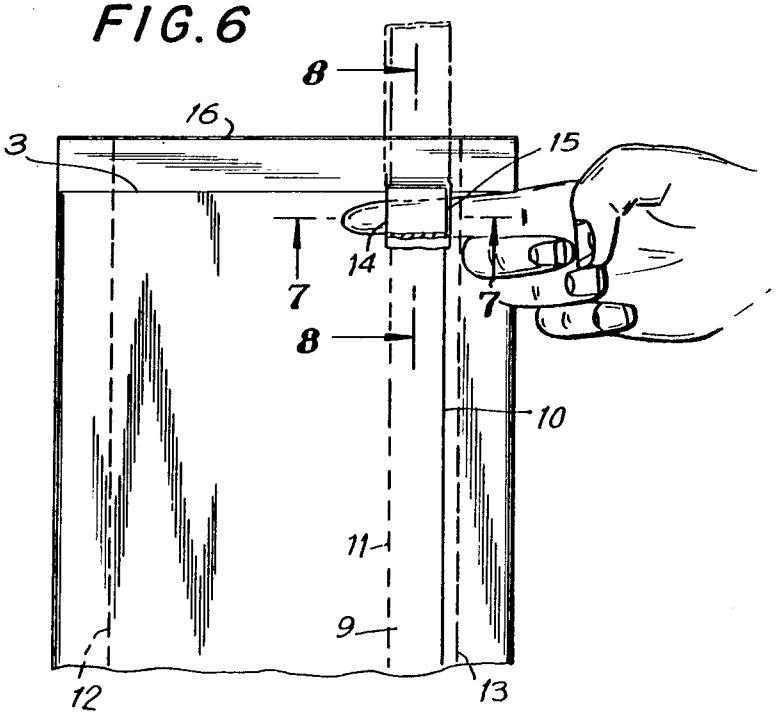
FIG. 6 is a front elevation of the bag of FIG. 4 showing the use of the easy open feature of the invention.
Figure 7:
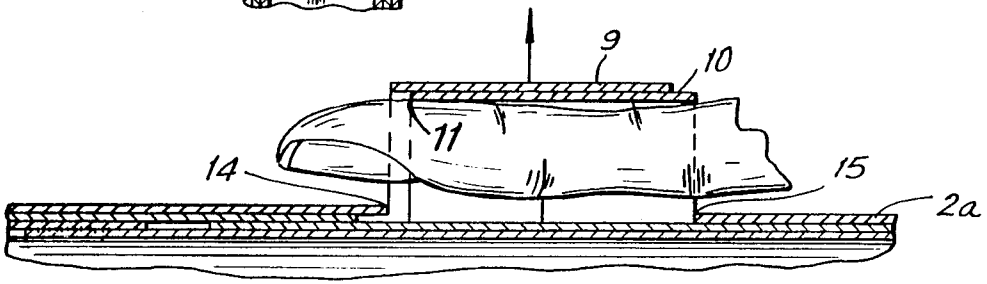
FIG. 7 is a cross-section along line 7—7 of FIG. 6 showing use of the easy open feature of the invention.

FIGS. 6, 7 and 8 illustrate operation of the easy-open feature of the instant invention. As shown in FIG. 6, the slits 14 and 15 are of sufficient length to permit the insertion of a finger, and as shown in FIGS. 7 and 8, a finger may be inserted underneath longitudinal seam 9. By lifting longitudinal seam 9 away from front wall 2*a*, the seam 9 may be broken at a point 18 to form a tab 19. Further lifting of tab 19 takes advantage of the higher strength of the overlapping longitudinal seam 9 to tear extension flap 3 longitudinally along the path overlying longitudinal seam 9. When torn to the vicinity of fold line 16, the pinch closure between the tear lines is released so as to permit the formation of an opening between the front wall and the back wall of the bag in the area formed by the tear.

If desired, a single slit corresponding to either slit 14 or slit 15 may be used. Because the instant invention takes advantage of the 2-ply strength of longitudinal seam 9, only a single slit or other means for breaking longitudinal seam 9 is needed. Once broken and lifted away from front wall 2*a*, the strength of seam 9 may be used to tear outer ply 6*a* along a path adjacent to the other edge of longitudinal seam 9 corresponding to the preferred location of a second slit. Also, a slit, per se, is not essential. For example, a line of perforation corresponding to slit 14 or 15 or both may be used. Other means will be apparent to those skilled in the art, however, it is important that such means be located adjacent to seam 9. Locating such means across seam 9 would unduly weaken a pinch closure bag.

Because the location of the easy-open feature of the present invention is dependent upon the location of longitudinal seam 9, the location of longitudinal seam 9 may be selected so as to take full advantage of this feature. For example, by locating longitudinal seam 9 in close proximity to a side-edge of the bag, a pour spout may be formed by employing the easy-open feature of the instant invention to open the bag.

When manufacturing easy-open pinch closure bags according to the instant invention, spot paste may be placed between adjacent plies of the walls of the bag in order to strengthen the bag. It is preferred, however, to place a minimal amount of spot paste between the outermost and next adjacent plies. A minimal amount of spot paste, as used herein, is that amount necessary to prevent shifting of the outermost ply relative to the next adjacent ply during manufacture and normal use of the bag while permitting release of the outermost ply from the next adjacent ply when the outermost ply is lifted away from the next adjacent ply. This enchances the effectiveness of the easy-open feature of the instant invention by permitting release of tab 19 from the underlying ply when using the easy-open feature. It is preferable in this regard to place spot paste between all of the plies as done conventionally, but at the same time, to place a minimal amount of spot paste between the outermost ply and the next adjacent ply along longitudinal seam 9. In this embodiment, it is possible to place even less than a minimal amount of spot paste along the seam, including no spot paste, because the spot paste placed in the other areas between the outermost and next adjacent plies provides sufficient strength to the bag. It is most preferred, to apply spot paste in a minimal amount, or less than a minimal amount, between the outermost ply and the next adjacent ply along longitudinal seam 9 from the end of the bag underlying the pinch closure to the vicinity of the means for breaking the outermost ply.

Thus, the instant invention provides a novel easy-open pinch closure bag which takes full advantage of the relatively higher strength of the two ply overlap of longitudinal seam 9 for use in opening the bag. The present invention also provides means which take full advantage of the weakness of a pinch closure, insofar as the seal of a pinch closure may be released by breaking the outermost ply of the overlapped wall. The novel easy-open pinch closure bag of the instant invention provides a reliable easy-open feature without the need for any extraneous additional devices while retaining the strength of conventional pinch closure bags not having an easy-open feature.

I claim:

1. An easy-open pinch closure bag comprising a multi-ply bag having a front wall, a back wall, and a pinch closure at one end, said pinch closure being formed by folding an extension of at least one of the plies of the back wall over the outside of the outermost ply of the front wall and adhesively securing said extension to the outermost ply of the front wall, said outermost ply of said front wall having a longitudinal seam formed by overlapped longitudinal edges of said outermost ply and means for breaking the outermost ply across said longitudinal seam.

2. The easy-open pinch closure bag of claim 1 wherein said means for breaking the outermost ply comprises a longitudinal slit adjacent an edge of said longitudinal seam in said outermost ply, said slit being of sufficient length to permit the insertion of a finger under the longitudinal seam of the outermost ply.

3. The easy-open pinch closure bag of claim 2 wherein said means for breaking the outermost ply further comprises a second slit adjacent the other edge of said longitudinal seam, said second slit being of sufficient length to permit the insertion of a finger under the longitudinal seam of the outermost ply.

4. The easy-open pinch closure bag of claim 1 wherein the longitudinal seam is located in close proximity to a side edge of the bag.

5. The easy-open pinch closure bag of claim 1 wherein spot paste has been placed between adjacent plies of the walls of the bag during its manufacture.

6. The easy-open pinch closure bag of claim 5 wherein a minimal amount of spot paste has been placed between the outermost and next adjacent plies.

7. The easy-open pinch closure bag of claim 5 wherein a minimal amount of spot paste has been placed between the outermost ply and the next adjacent ply along the longitudinal seam of the outermost ply.

8. The easy-open pinch closure bag of claim 7 wherein the amount of spot paste placed along the longitudinal seam of the outermost ply is minimal from the end of said longitudinal seam underlying said pinch closure to the vicinity of said means for breaking the outermost ply.

* * * * *